US007300198B2

(12) United States Patent
Khoo et al.

(10) Patent No.: US 7,300,198 B2
(45) Date of Patent: Nov. 27, 2007

(54) INTELLIGENT REVERSIBLE/REPLACEABLE BOTTOM PLATES FOR FLUID MIXERS

(75) Inventors: Christopher Khoo, Lake in the Hills, IL (US); William A. Miller, Buffalo Grove, IL (US)

(73) Assignee: Fluid Management, Inc., Wheeling, IL (US)

( * ) Notice: Subject to any disclaimer, the term of this patent is extended or adjusted under 35 U.S.C. 154(b) by 0 days.

(21) Appl. No.: 11/372,309

(22) Filed: Mar. 9, 2006

(65) Prior Publication Data

US 2007/0211569 A1 Sep. 13, 2007

(51) Int. Cl.
*B01F 11/00* (2006.01)

(52) U.S. Cl. ..... 366/209; 366/605

(58) Field of Classification Search ..... 366/110–111, 366/114, 208–211, 219, 605
See application file for complete search history.

(56) References Cited

U.S. PATENT DOCUMENTS

| | | | | |
|---|---|---|---|---|
| 4,134,689 | A * | 1/1979 | Ahrenskou-Sorensen | 366/110 |
| 4,842,415 | A * | 6/1989 | Cane et al. | 366/110 |
| 5,066,136 | A * | 11/1991 | Johnson | 366/209 |
| 5,904,421 | A * | 5/1999 | Mazzalveri | 366/213 |
| 6,827,480 | B2 * | 12/2004 | Morselli | 366/209 |
| 6,883,955 | B2 * | 4/2005 | Salas et al. | 366/110 |
| 2004/0202045 | A1 * | 10/2004 | Marazzi et al. | 366/209 |

FOREIGN PATENT DOCUMENTS

| | | |
|---|---|---|
| DE | 4416593 C1 * | 9/1995 |
| WO | WO 0204108 | 1/2002 |
| WO | WO 03028873 | 4/2003 |

OTHER PUBLICATIONS

International Searching Authority, "International Search Report and Written Opinion", Jul. 25, 2007, 15 Pages.

* cited by examiner

*Primary Examiner*—Charles E. Cooley
(74) *Attorney, Agent, or Firm*—Miller, Matthias & Hull

(57) ABSTRACT

A fluid mixer is disclosed which alters or changes the operation of the automatic clamping mechanism for different sizes, shapes and styles of containers. Removable and replaceable bottom plates are used on the lower base. These bottom plates have indicia on the resting surfaces thereof which provides the user with a clear indication as to which type of container is used with each plate surface. Typically, both surfaces of the replaceable/reversible bottom plates are used for different styles of containers. The bottom plate provides an identification to a sensor associated with a lower base for communicating a signal to the controller. By selecting the appropriate bottom plate and installing it on the lower base, a signal is generated and sent to the controller indicative of the type of container loaded into the mixing apparatus. The controller retrieves an appropriate algorithm or routine from its memory and imposes the appropriate clamping force by way of an upper plate that is lowered down into clamping engagement with a container or containers. Thus, one mixer can be used for a variety of different types, styles and sizes of containers.

20 Claims, 7 Drawing Sheets

17
CONTROLLER
50
19
74
25
20
130
24
42
52
22
44
27
27
48
46
15
49
23
23
28a
19
26
21
30
27
27
105
36
34
106
31
32
64
22
60a
62
56
21
22
60b

FIG. 4
Prior Art
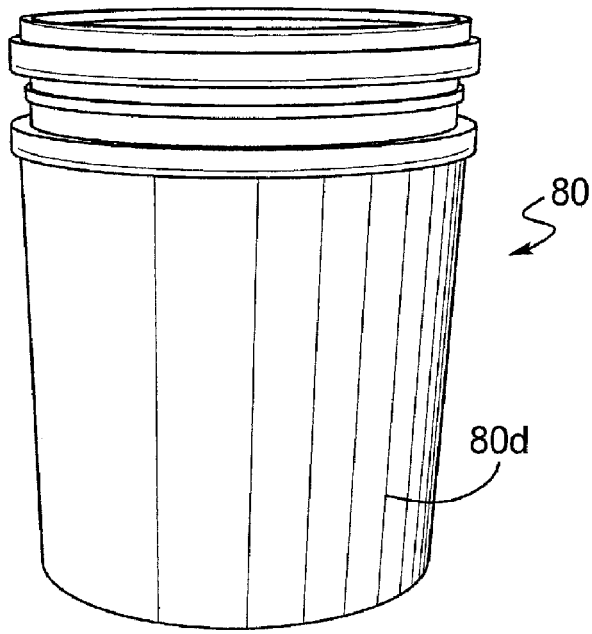
FIG. 5
Prior Art
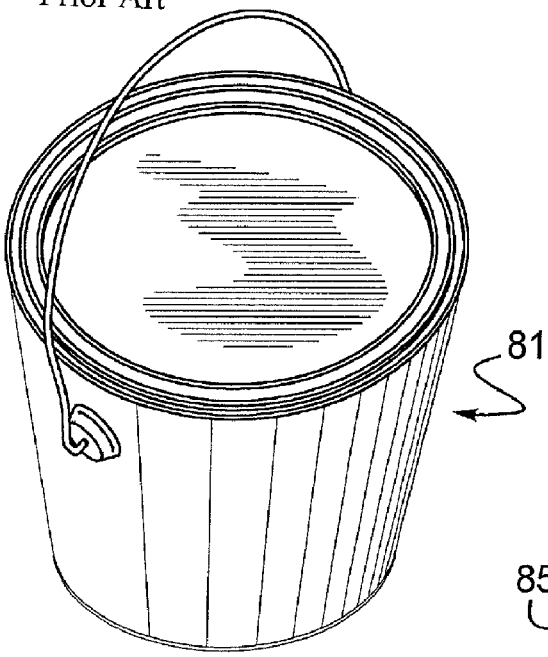
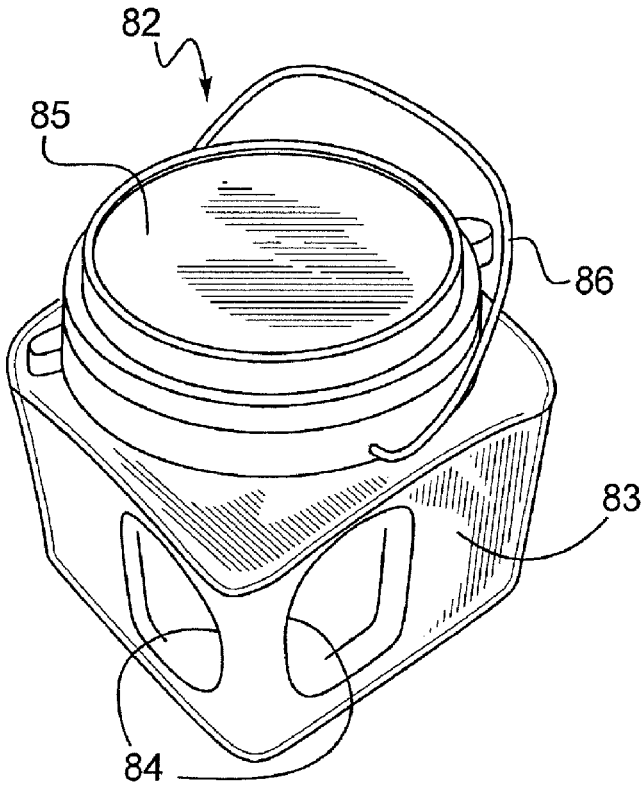
FIG. 6
Prior Art

INTELLIGENT REVERSIBLE/REPLACEABLE BOTTOM PLATES FOR FLUID MIXERS

BACKGROUND

1. Technical Field

A fluid mixer is disclosed which alters or changes the operation of an automated clamping mechanism depending on which bottom plate is selected for use by the operator. The bottom plate is selected based upon the type of container (s) holding the fluid product to be mixed. Specifically, different bottom plates are provided for a five gallon plastic bucket, one gallon metal cans, one gallon plastic jugs with rectangular bases, and various rectangular pans sized to accommodate a roller. Each plate includes recesse(s) or marking(s) to make it clear to the operator which type of container is to be used with each plate. Each plate has a tab, sensor activator or identifier which trips a sensor thereby sending a signal to the controller indicative of which type of container is being loaded into the mixer and the controller selects the appropriated clamp pressure, holding pressure, clamp motor current level and/or the distance the clamp plate travels after engaging the top(s) of the containers(s) to ensure the correct clamping force is exerted on the container or containers loaded into the mixer without crushing or damaging the container(s).

2. Description of the Related Art

Many types of fluids need to be mixed or blended into homogenous mixtures in the same containers in which they are sold to a consumer. One example of such in-container mixing results from colorants or pigments being added to base paints at a retail paint store or paint department of a home improvement store. The mixers or mixing machines may operate by vibration, roto-vibration, gyroscopic motion or rotational motion. The forces exerted on the containers during the mixing process are violent. To ensure that the container or containers stay in position during the violent mixing operation, various clamping mechanisms have been employed. Until recently, the amount of clamping force imposed on a container was not crucial as the containers were extremely rugged, e.g., a five gallon metal or plastic pail or a one gallon metal pail, and therefore difficult to damage by over clamping.

However, paint has become available in rectangular containers, giving rise to the need for paint mixers to blend colors for paint in such rectangular containers. One rectangular paint container has a handle molded into one corner for the painter's convenience in pouring paint from the container. Such rectangular paint container has a rectangular or square footprint or cross section. Another new type of container includes rectangular trays or trough-like buckets sized to receive a paint roller and pre-equipped with a screen or insert for engaging the roller. Smaller plastic cylindrical containers are also being used instead of the traditional metal cylindrical containers.

Most of the new types of containers are plastic and less robust than the older counterparts. Hence, an automatic clamping mechanism of a prior mixing machine is capable of crushing most, if not all, of the new types of containers. To avoid the problem of containers being crushed by the mixing machines, new and improved clamping mechanisms and automated clamping mechanisms are needed. Further, such clamping mechanisms must be versatile and capable of use on the various types of containers in the marketplace, both old and new, plastic, metal or combination plastic/metal, five gallon, one gallon, one and one half gallon, one quart and one pint sizes.

SUMMARY OF THE DISCLOSURE

In order to address the problem of applying the correct clamping pressure without crushing or damaging the container, an improved clamping mechanism for a mixing apparatus is disclosed.

The disclosed clamping mechanisms and methods use a bottom plate to identify which type of container is being loaded into the mixing machine. This information is communicated to a controller that recalls an appropriate clamping routine from memory to apply an appropriate clamping force to the container or containers loaded into the machine.

It will be noted that a plurality of intelligent bottom plates are provided, preferably one plate for each type of container. The plates can hold from one to four containers, depending upon the type of container.

One disclosed clamping mechanism comprises an upper plate and a lower base assembly. The lower base assembly comprises a lower base that supports a first bottom plate for clamping one or more containers between the first bottom plate and the upper plate. The first bottom plate comprises a first side and second side. The first side of the first bottom plate comprises first indicia thereon indicative of a first type of container to be supported on first side of the first bottom plate. The first bottom plate also comprises a first identifier. The lower base assembly comprises at least one base sensor that detects the first identifier when the first bottom plate is placed on the lower base with the first side facing the upper plate. The upper plate is coupled to a motor for movement towards and away from the first bottom plate. The upper plate comprises an upper sensor that senses when the upper plate engages or comes in close proximity to one or more containers disposed on the bottom plate. A controller is included for controlling the motor and movement of the upper plate and therefore the force imposed on the containers by the clamping action of the upper and bottom plates. The controller is linked to the at least one base sensor and the upper sensor. The controller controls the movement of the upper plate to exert a first force on one or containers disposed on the first side of the first bottom plate after the first identifier is detected by the at least one base sensor and upper sensor detects the presence of the one or more containers disposed on the first side of the first bottom plate.

In a refinement, the upper sensor can be replaced by the controller calculating the distance the upper plate needs to travel from its present location to the top or tops of the containers based upon the first identifier and height information of the first container(s) stored in the memory of the controller.

In a refinement, the indicia may be indentations shaped to receive a certain type of container. In another refinement, the indicia may be lines or graphics printed on the bottom plate.

In a refinement, the first bottom plate is removable from the lower base and rotatable so either the first side or the second side can face the upper plate. The second side of the first bottom plate has second indicia thereon indicative of a second type of container to be supported on the second side of the first bottom plate. The first bottom plate also comprises a second identifier that can be detected by the at least one base sensor when the bottom plate is placed on the lower base so the second side of the first bottom plate faces the upper plate. The controller then controls the movement of the upper plate to exert a second force on one or containers disposed on the second side of the first bottom plate after the second identifier is detected by the at least on base sensor and upper sensor detects a presence of the one or more containers disposed on the second side of the first bottom plate by the upper plate.

In a refinement, the first bottom plate is removable from the lower base and a second bottom plate may be disposed on the lower base in lieu of the first bottom plate. The second bottom plate has a third side and a fourth side. The second bottom plate is rotatable with respect to the lower base so either the third side or the fourth side can face the upper plate. In such a refinement, the third side of the second bottom plate has third indicia thereon indicative of a third type of container to be supported on the third side of the second bottom plate. The second bottom plate also comprises a third identifier that can be detected by the at least one base sensor when the third side of the second bottom plate faces the upper plate. The controller controls the movement of the upper plate to exert a third force on one or containers disposed on the third side of the second bottom plate after the third identifier is detected by the at least on base sensor and upper sensor detects a presence of the one or more containers disposed on the third side of the second bottom plate by the upper plate.

In a refinement, the fourth side of the second bottom plate has fourth indicia thereon indicative of a fourth type of container to be supported on the fourth side of the second bottom plate. The second bottom plate also comprises a fourth identifier that can be detected by the at least one base sensor when the fourth side of the second bottom plate faces the upper plate. The controller controls the movement of the upper plate to exert a fourth force on one or containers disposed on the fourth side of the second bottom plate after the fourth identifier is detected by the at least on base sensor and upper sensor detects a presence of the one or more containers disposed on the fourth side of the second bottom plate by the upper plate.

In a refinement, the types of containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

In a refinement, the first bottom plate is pivotally disposed within a first frame, the first frame being pivotally connected to the lower base. The first frame is capable of being pivoted upward away from the lower base and the first bottom plate is capable of being rotated within the first frame to switch from the first side of the first bottom plate facing the upper plate to the second side of the first bottom plate facing the upper plate and vice versa.

In a refinement, the at least one base sensor comprises a first two bit binary sensor for detecting the first and second identifiers.

In a refinement, the at least one base sensor comprises a first two bit binary sensor for detecting the first and second identifiers and a second two bit binary sensor for detecting the third and fourth identifiers.

In a refinement, the at least one base sensor comprises a first sensor for detecting the first identifier and a second sensor for detecting the second identifier.

In a refinement, the at least one base sensor comprises a first sensor for detecting the first identifier, a second sensor for detecting the second identifier, a third sensor for detecting the third identifier and a fourth sensor for detecting the fourth identifier.

In another refinement, a method of mixing fluid ingredients disposed within an enclosed container is disclosed. The method comprises:

selecting one or more first containers of like dimensions and a like base geometry to be subjected to a mixing operation;

selecting a first bottom plate having first indicia disposed on a first side thereof that matches the base geometry of the selected container or containers;

placing the bottom plate on a lower base with the first side facing upward towards an upper clamping plate;

detecting a first identifier associated with the first side of the bottom plate with at least one base sensor when the bottom plate is placed on the lower base with the first side facing the upper plate;

sending a signal from the at least one base sensor to a controller indicating which type of container or containers have been selected based on the first identifier;

placing the selected container or containers on the indicia of the first side of the first bottom plate so the base geometry or geometries of the container or containers are in alignment with the first indicia;

moving the upper plate towards the first bottom plate and the selected container or containers; and exerting a first force on the selected container or containers based on a first routine stored in a memory of the controller adapted for the type of container or containers selected.

In a refinement, the first bottom plate comprises a second side with second indicia disposed thereon matching a base geometry of a second type of container. The first bottom plate comprises a second identifier unique to the second type of container. The base sensor is capable of detecting the second identifier and sending a signal to the controller. The controller comprises a second routine for exerting a second force on the second selected container or containers adapted for the second containers.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 4 is a front perspective view of a typical five gallon bucket that can be accommodated by the disclosed mixing machine;

FIG. 5 is a top perspective view of a typical one gallon or one quart cylindrical metal or plastic or combination metal/plastic container that can be accommodated by the disclosed mixing machine;

FIG. 6 is a top perspective view of a typical square or rectangular plastic container with a built-in handle that can be accommodated by the disclosed mixing machine;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

The intelligent adjustable bottom clamp plates disclosed herein provide a convenient way to change the operation of automated clamping mechanism depending on the bottom plate that is selected for use by the operator. The selection of the bottom plate is made based upon the type of container. Indicia in the form of graphics, detents or clear signs make the plate choice straightforward for even inexperienced retail personnel.

A 2-bit binary sensor can set the mixer to a determined clamp pressure, holding pressure, current detection or distance traveled after can top detected. For a mixer intended to be used with four different containers, two 2-bit binary sensors can be used. Three or four 2-bit sensors can also be employed.

Figure 1:
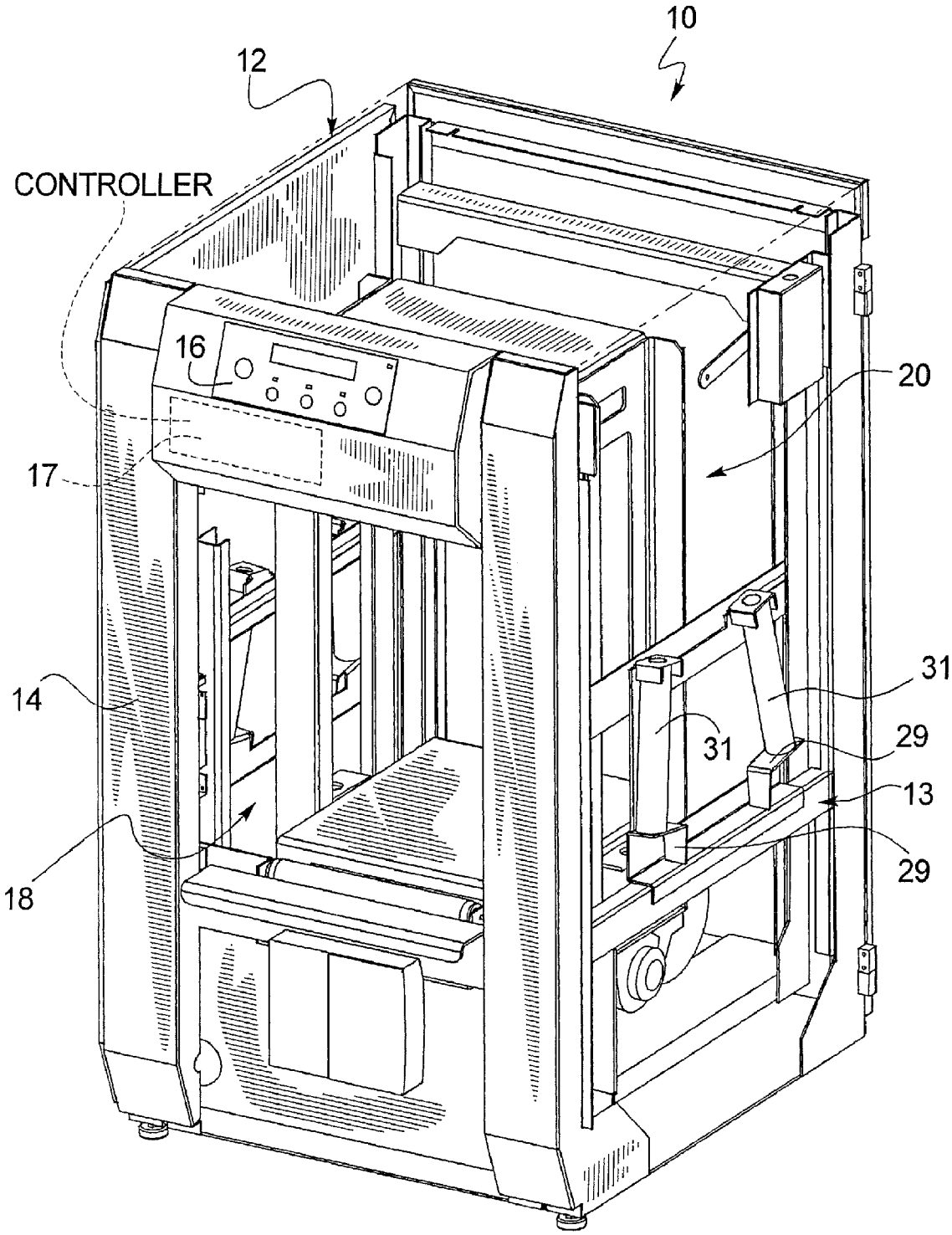
FIG. 1 is a perspective view of a mixing machine made in accordance with this disclosure.

Referring first to FIG. 1, a mixing apparatus 10 is shown having an outer enclosure 12. The outer enclosure 12 includes a front panel 14 having a controls area 16 in which may be provided input devices (such as switches and knobs) and output devices (such as a timer) for controlling and monitoring operation of the mixer. A controller is shown at 17 for controlling the clamping mechanism 19 shown in FIGS. 2 and 3. The front panel 14 also includes an access window or door 18 through which a user may access an interior of the enclosure 12.

Figure 2:
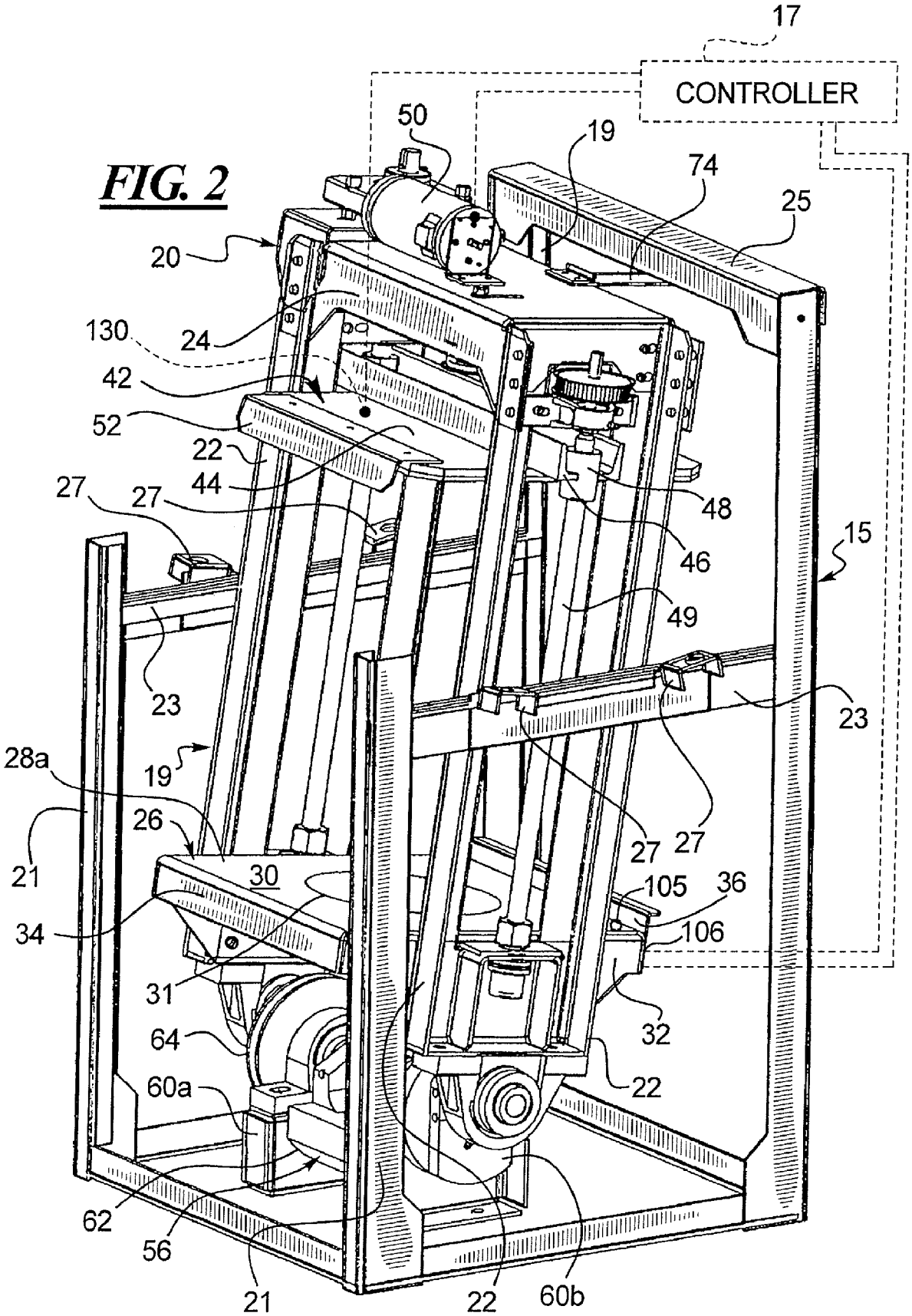
FIG. 2 is a right front perspective view of the internal shaker frame of the shaker-type mixing machine of FIG. 1.

An agitator frame assembly 20 is disposed inside the enclosure 12 for securing a container and for generating a reciprocating force that agitates the container and its contents. As best illustrated in FIG. 2, the agitator frame assembly 20 includes spaced first and second side supports 22, the top ends of which are connected by a cross member 24.

A stationary lower base 26 is attached to and extends between bottom portions of the side supports 22. In the illustrated embodiment, the lower base 26 accommodates a removable bottom plate 28*a* defining an upper surface 30 with a generally rectangular shape and an indicia 31 printed on the upper surface 30 that serves as an indicator to the user that the particular plate 28*a* of FIG. 2 is intended to support a large five gallon bucket or pail as described below. The lower base assembly 26 also includes two side panels 32, a front wall 34, and a rear wall 36 depending therefrom.

An upper plate 42 is disposed above the lower base 26 and is movable in a vertical direction to adjust the spacing between the lower base 26 and upper plate 42, to thereby accommodate containers of various sizes and to exert the desired clamping force on the container lid. As best shown in FIG. 2, the upper plate 42 has a generally rectangular shape and a u-shaped cross beam 46 is attached to a top face of the plate 42. A threaded coupling 48 is attached to each end of the u-shaped cross beam 46 and is sized to receive a threaded rod 49. A motor 50 is operably coupled to the threaded rods 49 by way of a pulley mechanism for rotating the rods in either the clockwise or counter-clockwise direction, thereby raising or lowering the upper plate 42 with respect to the lower base 26. The upper plate 42 may also include a front lip 52 to help retain the containers in place during the mixing operation.

The lower base 26 and upper plate 42 form an adjustable clamp for securely holding containers during operation of the mixer 10. A clamping area is defined between the lower base 26 and upper plate 42. Accordingly, a height of the clamping area will vary with the position of the upper clamp member 42 with respect to the clamp base 26, thereby allowing the adjustable clamp to accommodate containers of various heights. In addition, the open frame construction of the agitator frame assembly 20 accommodates various container sizes and shapes.

Figure 3:
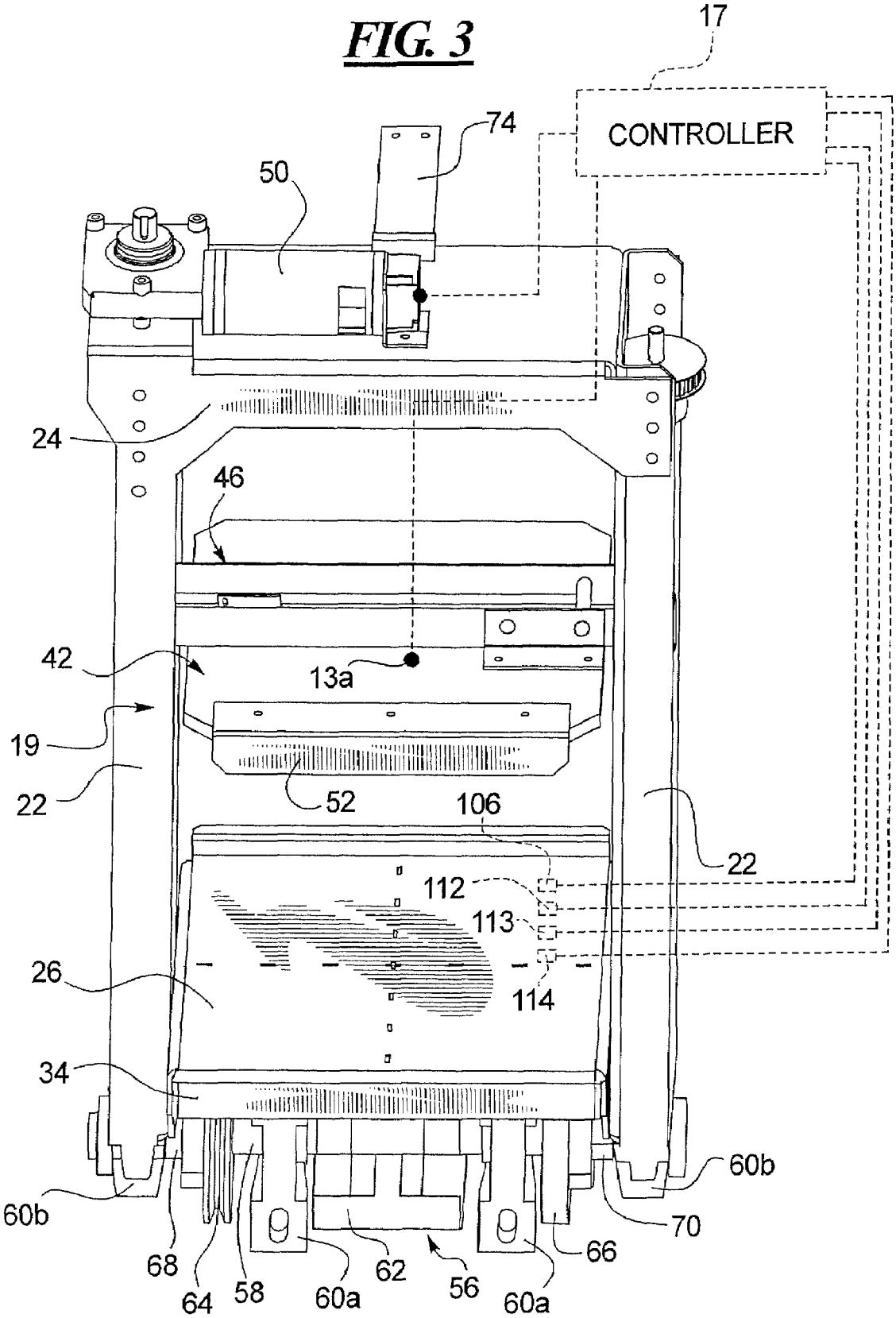
FIG. 3 is a front perspective view of the internal shaker frame of the shaker-type mixing machine of FIGS. 1 and 2.

An eccentric drive 56 is coupled to a bottom of the agitator frame assembly 20 for driving the frame assembly 20 in a reciprocating motion. As illustrated in FIGS. 2 and 3, the eccentric drive 56 includes a drive shaft 58 supported for rotation by two inner bearings 60*a* and a pair of stub shafts 68, 70 supported by outer bearings 60*b*. The bearings 60*b* may be pillow block bearings that are coupled to the stationary outer enclosure 12. A counterweight 62 is coupled to the drive shaft 58. A pulley 64 is attached to one end of the drive shaft 58 adapted to be rotatably driven, such as be a belt coupled to a motor (not shown). A coupling 66 is coupled to the end of the drive shaft 58 opposite the pulley 64. The first and second stub shafts 68, 70 are coupled to the pulley 64 and coupling 66, respectively. The stub shafts 68, 70 are aligned to have substantially the same axis, but are offset from an axis of the drive shaft 58, so that the stub shafts 68, 70 are eccentrically mounted with respect to the drive shaft 58. Outer ends of the stub shafts 68, 70 are rotatably received by the pillow block bearings 60*b*, which coupled to the bottom ends of the side supports 22. As a result, rotation of the drive shaft 58 causes the stub shafts 68, 70 to revolve about an axis of the drive shaft 58, thereby driving the frame assembly 20 in a reciprocating motion. The maximum displacement, or stroke, of the eccentric drive is determined by the distance between the drive shaft axis and the stub shaft axis.

The top of the agitator frame assembly 20 is secured to the outer enclosure 12 by a flexible link. For example, a slat 74 may have a first end attached to the cross member 24 (FIG. 2) and a second end coupled to the enclosure 12. The slat 74 may be flexible to act like a leaf spring, thereby to accommodate movement of the frame assembly 20 during operation of the mixer 10. Accordingly, the bottom end of the frame assembly 20 is secured to the enclosure 12 by the bearings 60 which receive the drive axis 58 and the top end of the frame assembly 20 is secured to the enclosure 12 by the slat 74, thereby maintaining the frame assembly 20 in an upright orientation.

Turning to FIGS. 4-8, five different fluid containers, in particular paint containers, are illustrated which are in current use or will be used in the near future. The containers shown in FIGS. 5-8 can be provided in one gallon, one quart and one and one half gallon sizes. One pint sizes are also available but may require a smaller mixer. FIG. 4 illustrates a five gallon plastic pail 80 that is sturdy or robust enough to withstand clamping forces by currently available mixer designs, such as that shown at 10 in FIGS. 1-3. The plastic pail 80 may also be fabricated from metal. Because of the sturdiness of this container 80, clamping pressure is not normally an issue.

Turning to FIG. 5, a typical metal cylindrical pail 81 is disclosed. The container 81 may be made from plastic or a combination of metal and plastic. The vertical walls and top provide a sturdy construction. The typical volume is one gallon. Like the five gallon container 80 shown in FIG. 4, the one gallon, one and one half gallon, one quart or one pint pail 81 is sturdy and over clamping or crushing for a conventional clamping apparatus is normally not a problem. The clamping pressure for a plastic embodiment of the pail 81 may need to be less than that for a metal pail 81.

Turning to FIG. 6, a new plastic container 82 is disclosed that has a generally cubical body 83 with a built-in handle shown at 84. The plastic container 82 includes a plastic round top 85 and a bail 86. The container 82, because of its plastic and lightweight construction, is not as strong or robust as the containers shown at 80, 81 in FIGS. 4 and 5, respectively. Therefore, any clamping pressure applied to the container 82 must be substantially less than that applied to the containers 80, 81. Further, because of its plastic construction, the structure of the container 82 can be somewhat compressed by a clamping mechanism. One way to control clamping pressure will be to allow only a certain amount of downward travel of the upper plate 42 after the upper plate 42 engages the top 85 of the container 82. This strategy will be discussed in greater detail below. Other strategies would be to limit the amount of clamping force imposed by the upper plate 42 on the container 82, limiting the current increase experienced by the motor 50 after the upper plate 42 engages the top 85 of the container 82 or simply measuring clamping or holding pressure and limiting the value of the pressure or force imposed on the container 82.

Figure 7:
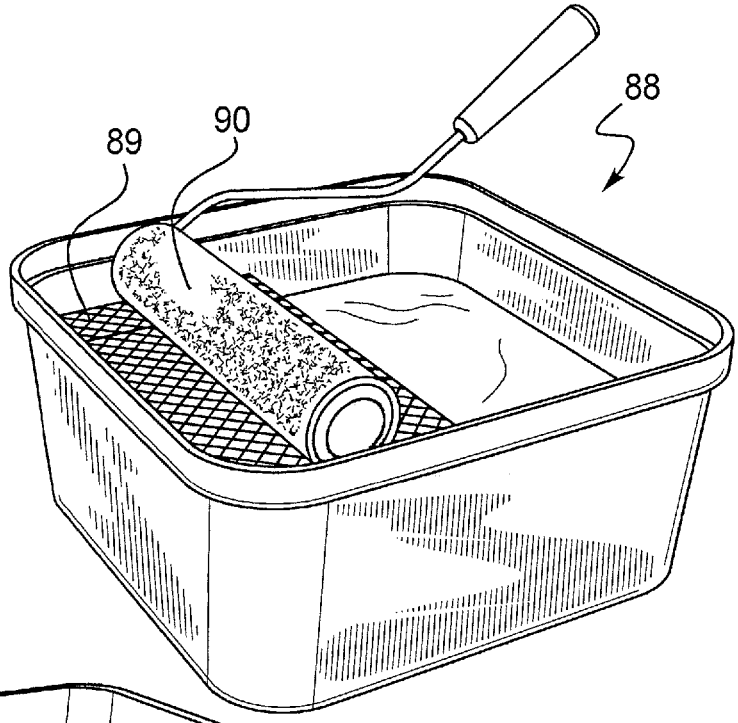
FIG. 7 Prior Art
FIG. 7 is a top perspective view of a typical rectangular plastic container equipped to receive a roller that can be accommodated by the disclosed mixing machine.

Similar strategies would need to be employed for the rectangular container 88 shown in FIG. 7 which has a rectangular body with a built-in screen or mesh 89 for receiving a roller shown at 90. The container 88 includes a rectangular top and is typically made of plastic or metal. Hence, the container 88 could be crushed or ruptured if the same force were imposed on the container 88 as that needed to secure a larger container 80 in place. Thus, the container 88, like the container 82 of FIG. 6, requires reduced clamping force. Similarly, the trough-like container 91 of FIG. 8 may be fabricated from plastic or metal and would therefore require a reduced clamping force.

Figure 9:
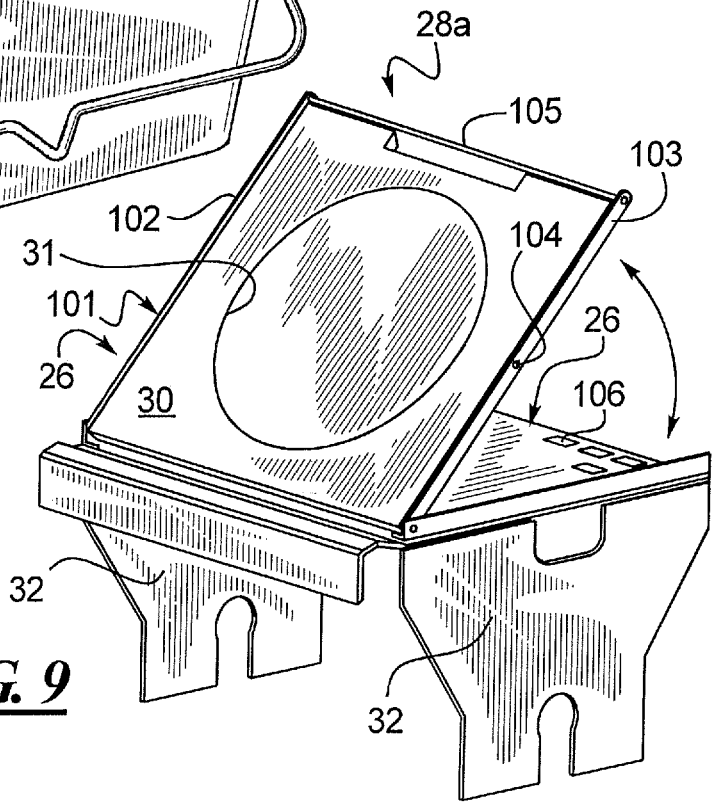
FIG. 9 is a right front perspective view of a bottom plate adapted for a single large plastic or metal bucket (e.g., 5 gal.) illustrating the plate pivoted upward away from the bottom clamping base thereby exposing the various sensors disposed on the bottom clamping base.
Figure 10:
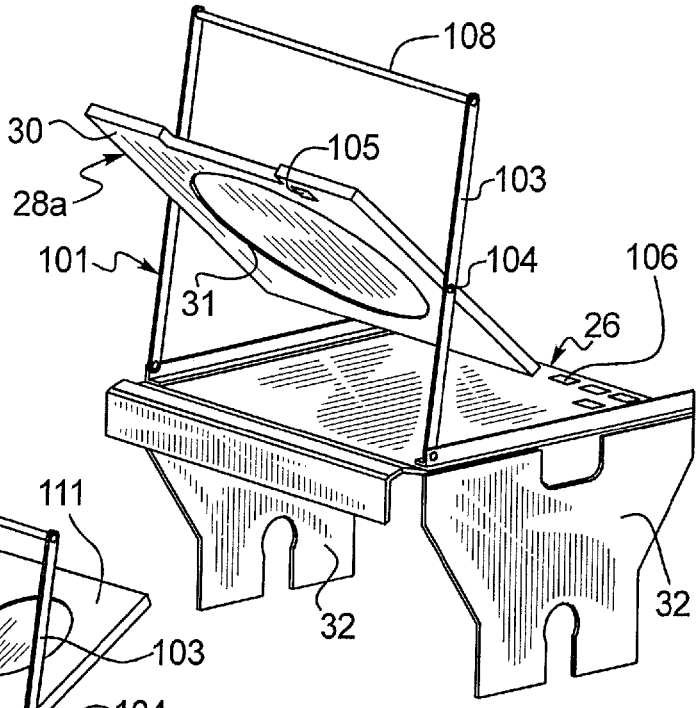
FIG. 10 is a right front perspective view of the bottom plate and bottom clamping base as shown in FIG. 9 as it is being rotated to a position where it can accommodate four smaller cylindrical containers (e.g., 1 or 1.5 gal.) as shown in FIG. 12 (the operational positions being shown in FIGS. 13-15)

Turning to FIGS. 9-15, various embodiments of the bottom plate 28*a* are shown. Turning first to FIGS. 2 and 9-12, the bottom plate 28*a* rests on top of the lower base 26. As shown in FIGS. 9-12, the bottom plate 20*a* is mounted within a frame 101 that include opposing side members 102, 103 that are pivotally connected to the bottom plate 28*a* by way of the pins shown at 104. In FIGS. 9 and 10, the surface 30, which we will refer to as the first surface 30 is shown. The first surface 30 includes a first indicia 31 which matches the base geometry 80*a* of the five gallon bucket container 80 shown in FIG. 4. Thus, the first surface 30 of the bottom plate 28*a* is intended to receive the five gallon bucket or pail shown at 80 in FIG. 4. The indicia 31 make this correlation straightforward for retail personnel with minimal training.

Further, the bottom plate 28*a* includes a first identifier shown schematically at 105 which provides an indication to the controller 17 that the first surface 30 is facing upward as shown in FIG. 2 thereby indicating to the controller 17 that the mixer 10 is ready to receive one five gallon bucket 80. The first identifier 105 is sensed by a sensor 106 associated with the lower base 26. When the lower plate 28*a* is in the position shown in FIG. 2, with the first surface 30 facing upwards towards the upper plate 42, the first identifier 105 is detected or sensed by the sensor 106 which, in turn, sends a signal to the controller 17. The controller then retrieves a clamping algorithm or routine from its memory for use on a larger, robust five gallon buckets or pails 80 to switch the apparatus 10 and make it ready for receiving and mixing containers of a different size, the bottom plate 28*a* is either flipped as shown in FIGS. 9-12, or replaced.

Figure 11:
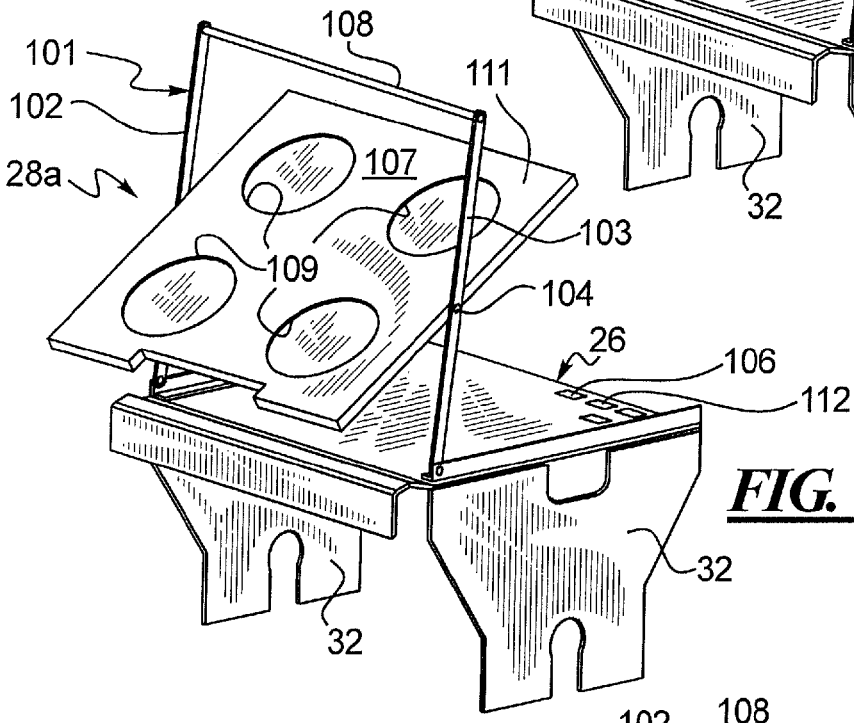
FIG. 11 is a right front perspective view of the bottom plate shown in FIGS. 9 and 10 as it is being further rotated towards the position shown in FIG. 12 with the operational position shown for other plates in FIGS. 13-15.
Figure 12:
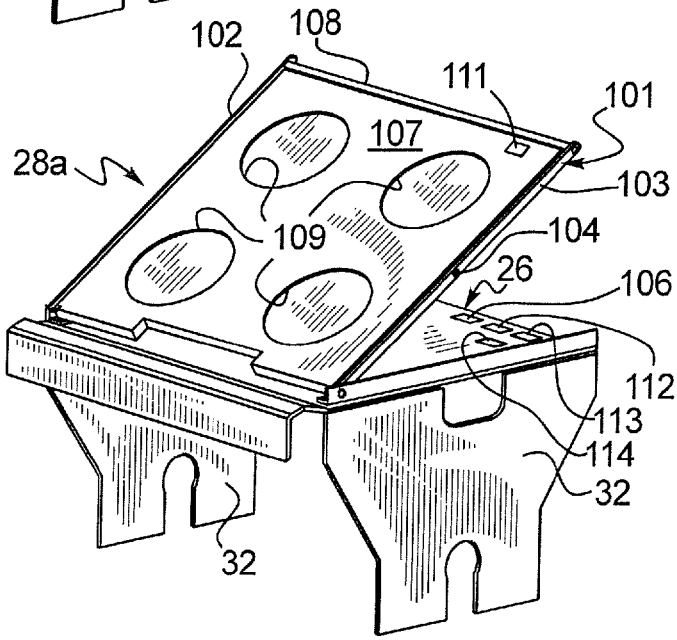
FIG. 12 is an another right front perspective view of the bottom plate shown in FIGS. 9-11 as it is being further rotated towards the operational position on the bottom clamping base as shown for other bottom plates in FIGS. 13-15.

To flip the bottom plate 28*a* so that the second surface 107 faces upward towards the upper plate 42, the bottom plate 28*a* may be disposed within a frame such as that shown at 101 and the operator can grasp the frame by a handle or crossbar 108, lifted upward away from the lower base 26 to the position shown in FIGS. 10 and 11 where the bottom plate 28*a* may be rotated so that the surface 107 is facing upward as shown in FIG. 11. Then the frame 101 and lower plate 28*a* may be lowered as shown in FIG. 12 so that the bottom plate 28*a* again rests on the lower base 26 with the second surface 107 facing upward. The second surface 107 includes a second indicia 109 that is clearly intended to receive four smaller pails or buckets like that shown at 81 in FIG. 5.

The bottom plate 28*a* also includes an additional identifier 111 which can be detected by the sensor 106 or even a separate sensor 112 which, in turn, will send a signal to the controller 17 that the bottom plate 28*a* is disposed on the lower base 26 with the second surface 107 facing upwards towards the upper plate 42. The controller will then recall a subroutine or an algorithm from its memory that is appropriate for the container 81 shown in FIG. 5 or, a more lightweight and less robust plastic container. If a two-bit sensor is employed, only a single sensor 106 needs to be used for both sides 30, 107 of the bottom plate 28*a*. Additional sensors are shown at 113, 114 which may be employed for additional bottom plates 28*e*-28*d* as shown in FIGS. 13-15.

Figure 13:
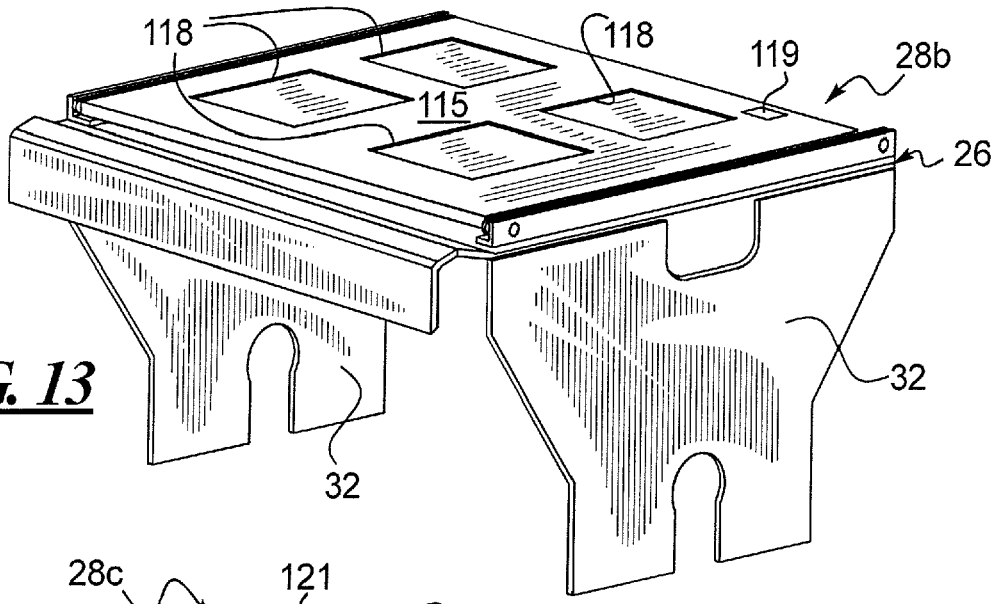
FIG. 13 is a right front perspective view of another bottom plate that can accommodate four square containers like the one shown in FIG. 6.
Figure 14:
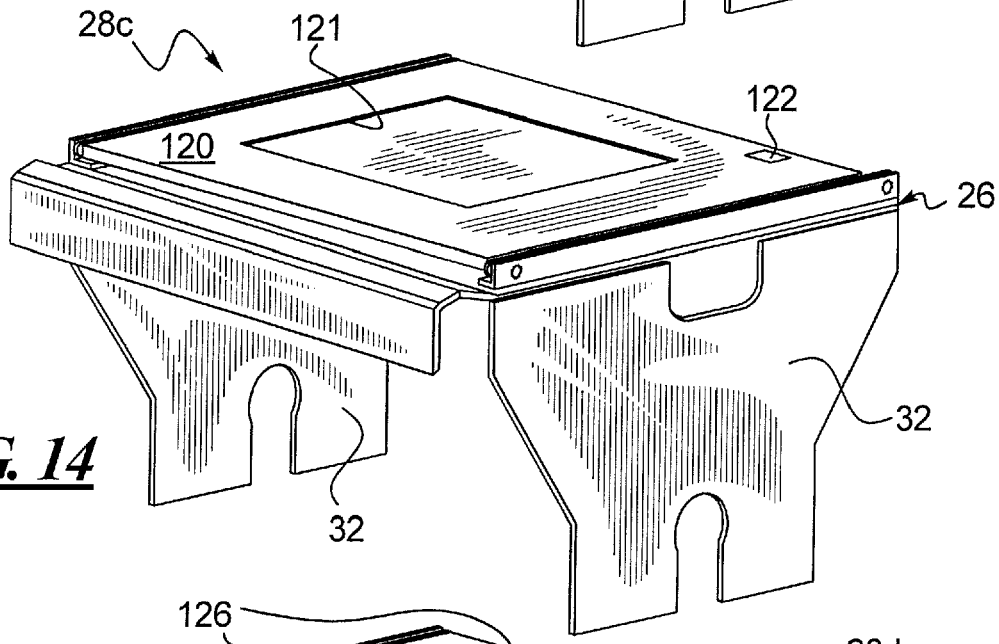
FIG. 14 is a right front perspective view of another bottom plate that can accommodate one rectangular container like the one shown in FIG. 7.

Turning to FIG. 13, the bottom plate 28*b* includes a first surface 115 with an indicia disposed thereon intended to invite the placement of four cubicle jug-like containers like that shown at 82 in FIG. 6. The bottom plate 28*b* also includes an additional identifier 119 with a purpose of generating a signal that is sent to the controller 17 in forming a controller 17 that containers like that shown at 82 have been placed on the bottom plate 28*b*. Similarly, an additional bottom plate 28*c* is shown in FIG. 14 with a first surface 120 having an indicia 121 disposed thereon that invites the placement of a rectangular container like that shown at 88 in FIG. 7. Again, an identifier 122 is provided for tripping the sensor 106 or being sensed by the sensor 106 or one of the sensors 112-114 for purposes of informing the controller 17 that a rectangular container 88 is disposed on bottom plate 28*c*. The bottom plate 28*c* may also be a reverse side of the bottom plate 28*b*.

Figure 8:
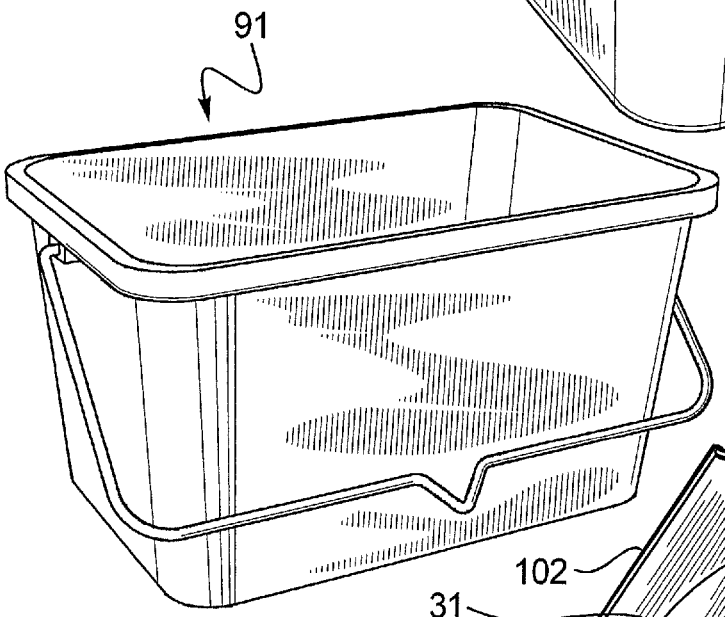
FIG. 8 Prior Art
FIG. 8 is a top perspective view of a typical trough-type plastic container that can be accommodated by the disclosed mixing machine.
Figure 15:
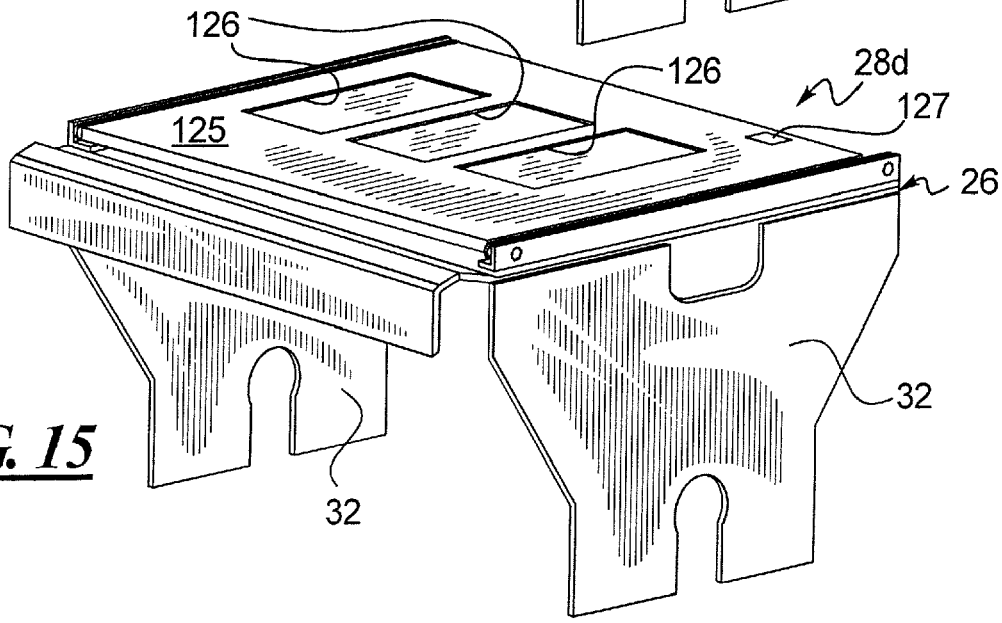
FIG. 15 is a right front perspective view of another bottom plate that can accommodate three rectangular trough-like containers, one of which is shown in FIG. 8

Turning to FIG. 15, an additional bottom plate 28*d* is shown with a surface 125 having an indicia 126 disposed thereon intended to invite the placement of trough-like containers like those shown at 91 in FIG. 8. Again, a separate identifier 127 is provided.

In operation, an operator readies the mixer 10 by manipulating the control panel 16. He or she then opens the door 18 and manipulates either the bottom plate 28*a* to the desired configuration (either the surface 30 facing upward towards the upper plate 42 or the surface 107 facing upward towards the upper plate 42). Or, in contrast, the operator selects a different bottom plate 28*b*, 28*c* or 28*d* with the appropriate indicia (30, 109, 118, 121, 126) facing upward towards the upper plate 42. As indicated above, placing the appropriate bottom plate 28*a*-28*d* on the lower base 26 with the correct side facing upwards towards the upper plate 42 results in a signal being automatically sent to the controller 17 regarding which type of container (80, 81, 82, 88, 91) is being loaded into the mixer 10. The controller then will retrieve an appropriate algorithm or routine so that the correct clamping pressure is applied by the upper plate 42.

It will be noted that the identifiers 105, 111, 119, 122 and 127 can be provided in a variety of designs, such as tabs, conductive elements, microchips, bar codes and the like. The identifier need only be unique to the particular surface or side 30, 109, 115, 120, 125 associated with the identifier so that the correct signal is sent to the controller 17. The sensing can be done by a variety of different types of sensors, including two-bit sensor barcode readers and other types that will be apparent to those skilled in the art.

Further, returning to FIGS. 2 and 3, most useful algorithms will start when the upper plate 42 engages or comes into close proximity with a top of a container or containers disposed on a bottom plate 28. Thus, a proximity sensor or other type of sensor 130 may be provided on the upper plate 42. The sensor 130 can also be a Hull effect sensor or similar device. The sensor 130 is linked to the controller providing the controller with the information that the upper plate 42 is either at or in abutting engagement with the top or tops of the containers disposed on the bottom plate 28. The controller then knows to institute the clamping algorithm or routine retrieved from the memory for the particular container involved.

While only certain embodiments have been set forth, alternatives and modifications will be apparent from the above description to those skilled in the art. These and other alternatives are considered equivalents and within the spirit and scope of this disclosure and the appended claims.

What is claimed:

1. A clamping mechanism comprising:

an upper plate and a lower base assembly, the lower base assembly comprising a lower base that supports a first bottom plate for clamping one or more containers between the first bottom plate and the upper plate, the first bottom plate comprising a first side and second side, the first side of the first bottom plate comprising first indicia thereon indicative of a first type of container to be supported on first side of the first bottom plate, the first bottom plate also comprising a first identifier, the lower base assembly comprising at least one base sensor that detects the first identifier when the first bottom plate is placed on the lower base with the first side facing the upper plate, the upper plate being coupled to a motor for movement towards and away from the first bottom plate, the upper plate comprising an upper sensor that senses when the upper plate engages or comes in close proximity to the one or more containers disposed on the bottom plate, a controller for controlling the motor and movement of the upper plate, the controller linked to the at least one base sensor and the upper sensor, the controller controlling the movement of the upper plate to exert a first force on the one or more containers disposed on the first side of the first bottom plate after the first identifier is detected by the at least one base sensor and the upper sensor detects the one or more containers disposed on the first side of the first bottom plate.

2. The mixer of claim 1 wherein the first bottom plate is removable from the lower base and rotatable so either the first side or the second side can face the upper plate, the second side of the first bottom plate having second indicia thereon indicative of a second type of container to be supported on the second side of the first bottom plate, the first bottom plate also comprising a second identifier that can be detected by the at least one base sensor when the second side of the first bottom plate faces the upper plate, and the controller controlling the movement of the upper plate to exert a second force on the one or more containers disposed on the second side of the first bottom plate after the second identifier is detected by the at least on base sensor and the upper sensor detects a presence of the one or more containers disposed on the second side of the first bottom plate.

3. The mixer of claim 2 wherein the first bottom plate is removable from the lower base and a second bottom plate may be disposed on the lower base in lieu of the first bottom plate, the second bottom plate having a third side and a fourth side, the second bottom plate being rotatable with respect to the lower base so either the third side or the fourth side can face the upper plate, the third side of the second bottom plate having third indicia thereon indicative of a third type of container to be supported on the third side of the second bottom plate, the second bottom plate also comprising a third identifier that can be detected by the at least one base sensor when the third side of the second bottom plate faces the upper plate, and the controller controlling the movement of the upper plate to exert a third force on the one or more containers disposed on the third side of the second bottom plate after the third identifier is detected by the at least on base sensor and the upper sensor detects a presence of the one or more containers disposed on the third side of the second bottom plate.

4. The mixer of claim 3 wherein the fourth side of the second bottom plate having fourth indicia thereon indicative of a fourth type of container to be supported on the fourth side of the second bottom plate, the second bottom plate also comprising a fourth identifier that can be detected by the at least one base sensor when the fourth side of the second bottom plate faces the upper plate, and the controller controlling the movement of the upper plate to exert a fourth force on the one or more containers disposed on the fourth side of the second bottom plate after the fourth identifier is detected by the at least on base sensor and the upper sensor detects a presence of the one or more containers disposed on the fourth side of the second bottom plate.

5. The mixer of claim 4 wherein the at least one base sensor comprises a first two bit binary sensor for detecting the first and second identifiers and a second two bit binary sensor for detecting the third and fourth identifiers.

6. The mixer of claim 4 wherein the at least one base sensor comprises a first sensor for detecting the first identifier, a second sensor for detecting the second identifier, a third sensor for detecting the third identifier and a fourth sensor for detecting the fourth identifier.

7. The mixer of claim 2 wherein the first bottom plate is pivotally disposed within a first frame, the first frame being pivotally connected to the lower base, the first frame capable of being pivoted upward away from the lower base and the first bottom plate being capable of being rotated within the first frame to switch from the first side of the first bottom plate facing the upper plate to the second side of the first bottom plate facing the upper plate and vice versa.

8. The mixer of claim 2 wherein the at least one base sensor comprises a first two bit binary sensor for detecting the first and second identifiers.

9. The mixer of claim 2 wherein the at least one base sensor comprises a first sensor for detecting the first identifier and a second sensor for detecting the second identifier.

10. The mixer of claim 1 wherein the types of containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

11. A clamping mechanism comprising:

an upper plate and a lower base assembly, the lower base assembly comprising a lower base that supports a first bottom plate for clamping one or more containers between the first bottom plate and the upper plate, the first bottom plate comprising a first side and second side, the first side of the first bottom plate comprising first indicia thereon indicative of a first type of container to be supported on first side of the first bottom plate, the first bottom plate being rotatable so either the first side or the second side can face the upper plate, the second side of the first bottom plate having second indicia thereon indicative of a second type of container to be supported on the second side of the first bottom plate, the first bottom plate also comprising a first identifier and a second identifier, the lower base assembly comprising at least one base sensor that detects the first identifier when the first bottom plate is placed on the lower base with the first side facing the upper plate, the at least one base sensor detecting the second indicia when the first bottom plate is placed on the lower base with the second side facing the upper plate, the upper plate being coupled to a motor for movement towards and away from the first bottom plate, the upper plate comprising an upper sensor that senses when the upper plate engages or comes in close proximity to one or more containers disposed on the bottom plate, a controller for controlling the motor and movement of the upper plate, the controller linked to the at least one base sensor and the upper sensor, the controller controlling the movement of the upper plate to exert a first force on the one or more containers disposed on the first side of the first bottom plate after the first identifier is detected by the at least one base sensor and the upper sensor detects a presence of the one or more containers disposed on the first side of the first bottom plate, and the controller controlling the movement of the upper plate to exert a second force on the one or more containers disposed on the second side of the first bottom plate after the second identifier is detected by the at least one base sensor and the upper sensor detects a presence of the one or more containers disposed on the second side of the first bottom plate.

12. The mixer of claim 11 wherein the first bottom plate is removable from the lower base and a second bottom plate may be disposed on the lower base in lieu of the first bottom plate, the second bottom plate having a third side and a fourth side, the second bottom plate being rotatable with respect to the lower base so either the third side or the fourth side can face the upper plate, the third side of the second bottom plate having third indicia thereon indicative of a third type of container to be supported on the third side of the second bottom plate, the second bottom plate also comprising a third identifier that can be detected by the at least one base sensor when the third side of the second bottom plate faces the upper plate, and the controller controlling the movement of the upper plate to exert a third force on the one or more containers disposed on the third side of the second bottom plate after the third identifier is detected by the at least on base sensor and the upper sensor detects a presence of the one or more containers disposed on the third side of the second bottom plate.

13. The mixer of claim 12 wherein the fourth side of the second bottom plate having fourth indicia thereon indicative of a fourth type of container to be supported on the fourth side of the second bottom plate, the second bottom plate also comprising a fourth identifier that can be detected by the at least one base sensor when the fourth side of the second bottom plate faces the upper plate, and the controller controlling the movement of the upper plate to exert a fourth force on the one or more containers disposed on the fourth side of the second bottom plate after the fourth identifier is detected by the at least on base sensor and the upper sensor detects a presence of the one or more containers disposed on the fourth side of the second bottom plate.

14. The mixer of claim 13 wherein the at least one base sensor comprises a first two bit binary sensor for detecting the first and second identifiers and a second two bit binary sensor for detecting the third and fourth identifiers.

15. The mixer of claim 11 wherein the types of containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

16. The mixer of claim 11 wherein the first bottom plate is pivotally disposed within a first frame, the first frame being pivotally connected to the lower base, the first frame capable of being pivoted upward away from the lower base and the first bottom plate being capable of being rotated within the first frame to switch from the first side of the first bottom plate facing the upper plate to the second side of the first bottom plate facing the upper plate and vice versa.

17. The mixer of claim 11 wherein the at least one base sensor comprises a first two bit binary sensor for detecting the first and second identifiers.

18. A method of mixing fluid ingredients disposed within an enclosed container, the method comprising:

selecting one or more first containers of like dimensions and a like base geometry to be subjected to a mixing operation, selecting a first bottom plate having first indicia disposed on a first side thereof that matches the base geometry of the selected container or containers, the bottom plate comprising a first identifier unique to the selected container or containers, placing the bottom plate on a lower base with the first side facing upward towards an upper clamping plate, detecting the first identifier with at least one base sensor when the bottom plate is placed on the lower base with the first side facing the upper plate, sending a signal from the at least one base sensor to a controller indicating which type of container or containers have been selected based on the first identifier, placing the selected container or containers on the indicia of the first side of the first bottom plate so the base geometry or geometries of the container or containers are in alignment with the first indicia, moving the upper plate towards the first bottom plate and the selected container or containers, exerting a first force on the selected container or containers based on a first routine stored in a memory of the controller adapted for the type of container or containers selected.

19. The method of claim 18 wherein the first bottom plate comprises a second side with second indicia disposed thereon matching a base geometry of a second type of container, the first bottom plate comprises a second identifier unique to the second type of container, the base sensor capable of detecting the second identifier and sending a signal to the controller, the controller comprising a second routine for exerting a second force on the second selected container or containers adapted for the second containers.

20. The method of claim 18 wherein the types of containers are selected from the group consisting of five gallon cylindrical plastic pails, five gallon cylindrical metal pails, one gallon cylindrical metal pails, one gallon cylindrical plastic pails, one gallon cylindrical combination plastic/metal pails, one gallon cubically shaped plastic container with a round lid and integrated handle, one and one-half gallon cubically shaped plastic container with a round lid and integrated handle, one and one-half gallon rectangular plastic trough with rectangular lid, one gallon rectangular plastic trough with rectangular lid, one quart cylindrical metal pails, one quart cylindrical plastic pails, one quart cylindrical combination plastic/metal pails, one quart cubically shaped plastic container with a round lid and integrated handle, one quart rectangular plastic trough with rectangular lid, one pint cylindrical metal pails, one pint cylindrical plastic pails, one pint cylindrical combination plastic/metal pails, one pint cubically shaped plastic container with a round lid and integrated handle, and one pint rectangular plastic trough with rectangular lid.

* * * * *